US011700876B1

(12) United States Patent
Lutsevych et al.

(10) Patent No.: US 11,700,876 B1
(45) Date of Patent: Jul. 18, 2023

(54) DEVICE AND METHOD FOR PRODUCTION OF A SMOKING PRODUCT TUBULAR ELEMENT

(71) Applicant: HOKORD LIMITED, Sheung Wan Hong Kong (HK)

(72) Inventors: Oleksandr Lutsevych, Zhytomyr (UA); Yurii Lykhovyd, Kyiv (UA)

( * ) Notice: Subject to any disclaimer, the term of this patent is extended or adjusted under 35 U.S.C. 154(b) by 0 days.

(21) Appl. No.: 17/858,101

(22) Filed: Jul. 6, 2022

(51) Int. Cl.
*A24C 5/46* (2006.01)
*B31C 7/04* (2006.01)

(52) U.S. Cl.
CPC . *A24C 5/46* (2013.01); *B31C 7/04* (2013.01)

(58) Field of Classification Search
None
See application file for complete search history.

(56) References Cited

U.S. PATENT DOCUMENTS 2,644,376 A * 7/1953 Raymond ..... B65H 75/10 493/296
3,402,646 A * 9/1968 Hall ..... B31C 7/08 493/379
10,709,169 B1 * 7/2020 Richmond ..... A24D 1/025

FOREIGN PATENT DOCUMENTS

WO WO-2021156816 A1 * 8/2021 ..... A24C 5/002
WO WO-2021156817 A1 * 8/2021 ..... A24C 5/465
WO WO-2021156818 A1 * 8/2021 ..... A24C 5/465

* cited by examiner

*Primary Examiner* — Michael J Felton

(57) ABSTRACT

A device for production of a smoking product tubular element that consists of a set of components for a paper workpiece processing. The set of components including a working table with a moving platform and a master form fixed. The master form's working surface is formed by a first side wall surface, a second side wall surface and a bottom surface. The device also includes a first moving forming unit and a second moving forming unit on the working table and at least one moving mandrel with a flat working section and equipped with a non-flat shape tip.

The moving mandrel is designed for pressing the paper workpiece to the working surface of the master form, and the moving mandrel is designed to be folded by the paper workpiece around the flat working section by the first and second moving forming units.

20 Claims, 8 Drawing Sheets

DEVICE AND METHOD FOR PRODUCTION OF A SMOKING PRODUCT TUBULAR ELEMENT

FIELD OF THE INVENTION

The said invention group is related to production equipment and a method for producing paper tubular elements of cigarettes, both of cylindrical and cone shape, in particular, is advantageously applicable in producing tubular truncated-cone elements consequently used for producing corresponding cigarettes.

BACKGROUND OF THE INVENTION

A lot of devices and methods are known from the prior art, which allow to make paper tubular elements for smoking products.

One of the first solutions is described in the U.S. patent, containing a stem and a horizontal cone rotating mandrel installed with cinematic connection to a rotatable driver ["Paper tube winding apparatus", inventor RAYMOND JOSEPH H, publication date Jul. 7, 1953] [1].

Analogously, the U.S. Pat. No. 3,402,646A discloses a device for paper cones production, containing a stem and a cone-shaped section connected with the drive means for continuously rotating. ["PAPER CONE ROILING APPARATUS", inventor HALL LESTER F, publication date Sep. 24, 1968] [2].

The disadvantage of known technical solutions [1; 2] is manual fixation of a paper workpiece on the cone mandrel which increases the labor intensity of obtaining the paper cone and winding the paper workpiece on the conical mandrel.

The further improvement of the machines and apparatuses for producing paper cones is directed towards mechanization of the operations held for fixing a paper workpiece on a cone mandrel.

The US patent «CONICAL PAPER FABRICATOR», U.S. Ser. No. 10/709,169A1 (BANANA BROS LLC [U.S.]), A24C5/44; A24C5/46; A24D1/02; Jul. 14, 2020 [3] describes an apparatus for producing tubular elements, which includes a mandrel having a plurality of openings provided therein, a surface comprising a receiving indentation configured to receive and fit on the rotatable mandrel, suction device. The suction producing arrangement draws air through the plurality of openings while the mandrel rotates so that the drawn air draws the rolling paper toward and around the rotatable mandrel forming a tubular element.

The disadvantage of the described technical solution [3] is winding the paper workpiece around a rotating mandrel, which requires the use of controlled drive mechanisms containing many elements that are worn in the process.

In addition, the known device does not provide the tubular element with a sufficient strength for the smoking product, because of the process of bonding the ends of the paper workpiece with glue on the mandrel surface.

These disadvantages significantly complicate the design and technology of manufacturing cylindrical paper products and reduce their quality.

The most relevant to the present technical solution is a fully automated machine and a method for producing tubular paper elements, and smoking products [«MANUFACTURING MACHINE AND MANUFACTURING METHOD FOR THE PRODUCTION OF A TUBULAR ELEMENT, IN PARTICULAR FOR A SMOKING ARTICLE)» WO2021156816 (SASIB SPA [IT]) A24C5/46; B31C7/02; Dec. 8, 2021] [4].

According to the invention, the machine comprising the mandrel and the master form. The master form comprises a working surface which forms a pocket for the paper workpiece positioning.

The mandrel is shaped like an inner cavity of the paper tubular element, and the paper tubular element manufacturing process involves bending a U-shaped paper workpiece and winding it around the rotating mandrel, and gluing the ends of the paper workpiece.

The disadvantage of the described invention is forming a paper tubular element by winding a paper workpiece on a rotating mandrel, and binding the paper workpiece ends along the spiral line, and if the glue goes beyond the ends of the paper blank and gets on the mandrel surface, the workpiece sticks to the mandrel, which requires constant regulation of an air flow for the paper tubular element extraction, or stopping the machine and removing paper workpiece by hand.

In addition, the described method leads to defects in the finished products.

The disadvantage of the described invention is the technology and method complexity of the smoking product tubular element production. It significantly complicates the components design, the kinematic scheme of the described machine, as well as the technology of manufacturing smoking products tubular elements, especially in terms of gluing the tubular elements.

BRIEF SUMMARY OF THE INVENTION

The technical problem, the solution of which is the aim of the present invention, is to simplify the design of the device and method of manufacturing the smoking product tubular element, as well as improving the reliability.

In order to achieve the technical result, the device for production of a smoking product tubular element according to the first variant consists of a set of components for a paper workpiece processing. Wherein, the set of components comprising at least:

a working table, a moving platform installed on the working table, a master form fixed on the working table surface.

The working surface of the master form is formed by a first side wall surface, a second side wall surface and a bottom surface.

The device also comprising a first moving forming unit and a second moving forming unit which are placed on the working table on both sides of the master form.

According to the first variant, the device comprising at least one moving mandrel, wherein the moving mandrel is designed with a flat working surface and hinged to the moving platform. The moving mandrel is equipped with a non-flat shape tip.

Wherein, the moving mandrel is designed for pressing the paper workpiece to the working surface of the master form. Also, the moving mandrel is designed to be folded by the paper workpiece around the flat working surface by an influence of the first and second moving forming units. According to the present invention the smoking product tubular element is formed around the moving mandrel in a shape of the flat working surface.

The device for production of a smoking product tubular element, according to the second variant, consists of a set of components for a paper workpiece processing.

Wherein, the set of components comprising at least:
the working table,
the moving platform installed on the working table,
the master form fixed on the working table surface and positioned radially to the moving platform with the working surface for the paper workpiece positioning.
Wherein, the working surface is formed by the first side wall surface, the second side wall surface and the bottom surface.

The device, according to the second variant of the present invention, comprising the first moving forming unit and the second moving forming unit that are placed on the working table radially to the moving platform. The first moving forming unit and the second moving forming unit are formed to cover the master form on two opposite sides. Wherein, the second moving forming unit is equipped with an adhesive composition application unit. At least four moving mandrels hinged to the moving platform by a shaft.

The moving mandrel is designed for rotation in a plane perpendicular to the working table surface. The moving mandrel is designed with the flat working surface for pressing the paper workpiece to the working surface of the master form. At least one moving mandrel is equipped with a non-flat shape tip.

According to the present invention the smoking product tubular element is formed around the moving mandrel in a shape of the flat working surface. The set of components comprising a first extractor and a second extractor installed on the working table. The first extractor is designed for the tubular element longitudinal displacement out of the mandrel. The second extractor is designed in contact with the non-flat shape tip of each of the moving mandrel.

The device according to both possible variants may be equipped by a storage device and an additional cleaning unit of the moving mandrel.

The moving mandrel is installed for rotating around the moving mandrel rotation axis within a range of up to 270 angular degrees. The moving mandrel comprising a spring mechanism mounted on the shaft.

The second extractor consists of two eccentric and spring-loaded friction rollers, wherein the said friction rollers contact with the tubular element around the non-flat shape tip of the moving mandrel.

According to the present invention the moving mandrel's flat working surface is made with a thickness of at least 0.5 mm. Also, the moving mandrel rotation axis is perpendicular to the positioning axis of the paper workpiece within the master form.

The moving mandrel is installed with a possibility of plane-parallel or rotationally reciprocating motion relative to the moving mandrel rotation axis in the plane perpendicular to the working table surface.

According to at least one of possible variants of the invention, the adhesive composition application unit comprising a carriage mechanism, at least one guide rod, a drive mechanism with a drive rail, a nozzle, wherein the nozzle is installed on the carriage mechanism and connected to an adhesive capacity through a pump with a pipeline.

At least one moving forming unit is designed to rotate in a parallel plate relative to the working table surface.

The moving mandrel can be positioned on the moving platform or on the working table surface.

In order to achieve the technical result providing a method of smoking product tubular element production by using a set of components, according to the possible design variants of the device for the paper workpiece processing, comprising steps:

a) placing a paper workpiece above a master form,
wherein the paper workpiece first side sections and the second side section are spaced out of the working surface of the master form;

b) pressing the paper workpiece to the working surface of the master form by using the moving mandrel,
wherein the working surface is formed by a first side wall surface, a second side wall surface and a bottom surface;

c) moving the first moving forming unit until contact the first side section of the paper workpiece;

d) folding the second side section of the paper workpiece around the moving mandrel's flat working surface by moving the second moving forming unit toward the first moving forming unit,
wherein fixing the first side section between the first and the second moving forming units;

e) applying an adhesive to the first side section surface of the paper workpiece;

f) pressing the first side section to the second side section of the paper workpiece by synchronous movement of the first and second moving forming units toward a direction of an initial position of the second moving forming unit;

g) moving back the first and the second moving forming units;

h) extracting the moving mandrel out of the master form both with a formed smoking product tubular element;

i) extracting the formed smoking product tubular element by using at least one extractor.

The method according to the present invention, wherein moving the second moving forming unit toward the first moving forming unit till the moment of fixing the first side section of the paper workpiece between the first and the second moving forming units.

Also, according to the described method, forming a tubular shape of the smoking product tubular element by using at least non-flat shape tip of the moving mandrel.

The claimed invention allows to simplify the construction of the device and manufacturing method of the smoking product tubular element, due to the fact of providing the tubular elements manufacturing without winding the paper workpiece on the moving mandrel.

The described method of folding the paper workpieces makes it possible to form a direct seam connection of the tubular element.

Forming the direct seam connection of the paper workpiece, allows to:

reduce the amount of glue required to gluing the ends of the paper workpiece, reduces the likelihood of glue getting on the surface of the tubular element, which in future use in the smoking products allows to improve the taste of a cigarette, reduces the likelihood of the glue getting on the moving mandrel surface and the working surfaces of other parts of the device, thus avoiding sticking of tubular elements, which allows to simplify extraction of finished tubular elements. The described invention allows to reduce the requirement of a constant air flow adjustment to extraction of the tubular elements, and eliminates the need for manual work.

reduces the number of defective products and production costs.

Thus, the claimed invention allows to simplify the construction of the device and the method of tubular elements manufacturing with increasing the device reliability.

BRIEF DESCRIPTION OF THE SEVERAL VIEWS OF THE DRAWINGS

The said invention is explained by the drawings, wherein.

LIST OF TERMS OF THE INVENTION

Figure 1:
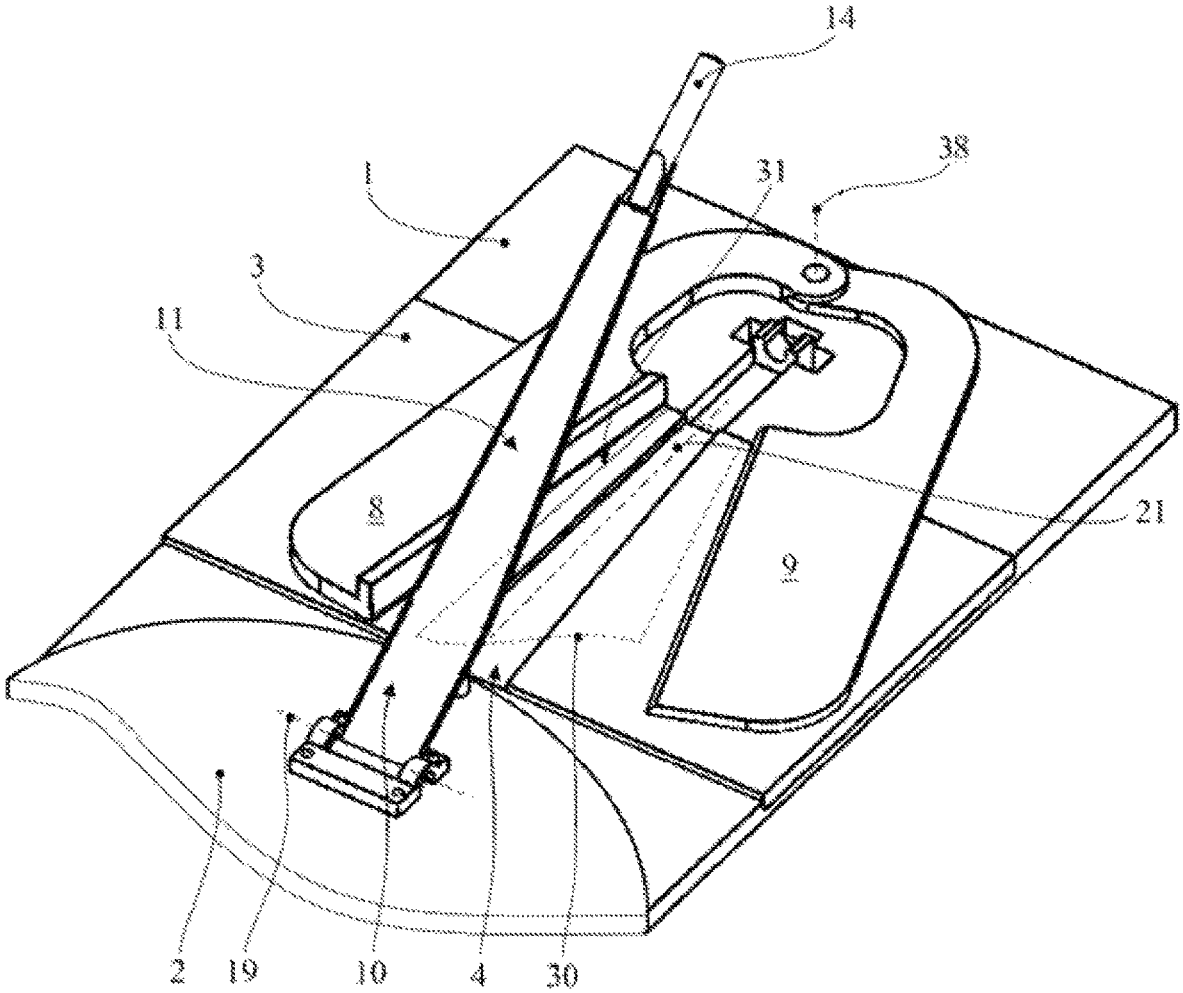
FIG. 1—shows a device for production of a smoking product tubular element (first variant)

| | |
|---|---|
| a working table (1) | an additional cleaning unit (18) |
| a moving platform (2) | a moving mandrel rotation axis (19) |
| a master form (3) | a spring mechanism (20) |
| working surface of the master form (4) | a positioning axes (21) |
| a first side wall surface (5) | a carriage mechanism (22) |
| a second side wall surface (6) | a guide rod (23) |
| a bottom surface (7) | a drive mechanism (24) |
| a first moving forming unit (8) | a drive rail (25) |
| a second moving forming unit (9) | a nozzle (26) |
| a moving mandrel (10) | a pump (27) |
| a flat working surface (11) | a pipeline (28) |
| an adhesive composition application unit (12) | an adhesive capacity (29) |
| a moving mandrel shaft (13) | a paper workpiece (30) |
| a non-flat shape tip (14) | the paper workpiece first side section (31) |
| a first extractor (15) | the paper workpiece second side section (32) |
| a second extractor (16) | a smoking product tubular part (33) |
| a storage device (17) | a top working surface (34) |
| a front working surface (35) | a first drive section hole (45) |
| a bottom working surface (36) | a second working section (46) |
| a side working surface (37) | a second drive section (47) |
| a common axes (38) | a second drive section figured notch (48) |
| a cylindrical working surface (39) | a lengthwise chamfer (49) |
| a moving platform axes (40) | a second drive section hole (50) |
| a first working section (41) | a flat base component (51) |
| a first drive section (42) | a first limiting flat section (52) |
| a figured notch (43) | a second limiting flat section (53) |
| a lengthwise stiffening rib (44) | |

BRIEF DESCRIPTION OF THE PREFERRED EMBODIMENT

The variant of the invention (FIG. 1) shows a device for production of a smoking product tubular element which consists of a set of components for a paper workpiece processing. Wherein, the set of components comprising at least a working table 1, a moving platform 2 installed on the working table 1, a master form 3 fixed on the working table's 1 surface. The moving platform 2 may be designed as a rotating platform (as shown in FIG. 2) or a forward moving platform. According to one of the possible embodiments of the invention, the master form 3 can be installed radially or perpendicularly relative to the moving platform 2. A working surface 4 of the master form 3 is formed by a first side wall surface 5, a second side wall surface 6 and a bottom surface 7. A first moving forming unit 8 and a second moving forming unit 9 are placed on the working table 1 on both sides of the master form 3. The first and the second moving forming units are formed to cover the master form 3 on two opposite sides.

The device comprising at least one moving mandrel 10 (FIG. 3; 4), wherein each of the moving mandrel 10 is designed with a flat working section 11 and installed for movement relative to the moving platform (2). According to one of possible embodiments of the invention the moving mandrel 10 is hinged to the moving platform 2. Also the moving mandrel 10 can be designed for plane-parallel movement relative to the moving platform (2). Such design allows pressing the paper workpiece to the working surface 4 of the master form 3, wherein the paper workpiece is pressed to the first side wall surface 5, the second side wall surface 6 and the bottom surface 7 of the working surface 4. The said moving mandrel 10 is designed to be folded by the paper workpiece around the flat working section 11 by an influence of the first 8 and second 9 moving forming units. Wherein, the smoking product tubular element is formed around the moving mandrel 10 in a shape of the flat working section 11, for example a flat cone shape. The moving mandrel flat working section 11 is made with a thickness of at least $\delta$=0.5 mm. One of the moving forming units can be equipped with an adhesive composition application unit 12.

According to the possible embodiments of the invention (FIG. 2) at least four moving mandrels 10 are hinged to the moving platform 2 by a shaft 13 for rotation in a plane perpendicular to the working table's 1 surface. Another possible variant of the invention may comprise at least four moving mandrels 10, designed for plane-parallel movement relative to the moving platform (2). In such embodiments of the invention, each moving mandrel 10 comprising the flat working section 11 for pressing the paper workpiece to the first side wall surface 5, the second side wall surface 6 and the bottom surface 7 of the working surface 4.

Figure 4:
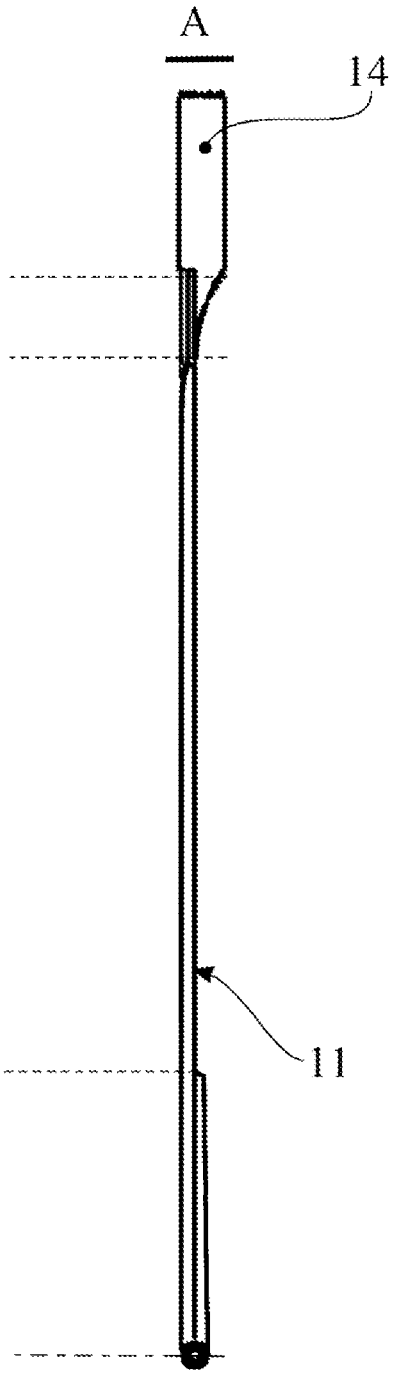
FIG. 4—shows the view A on FIG. 3.
Figure 5:
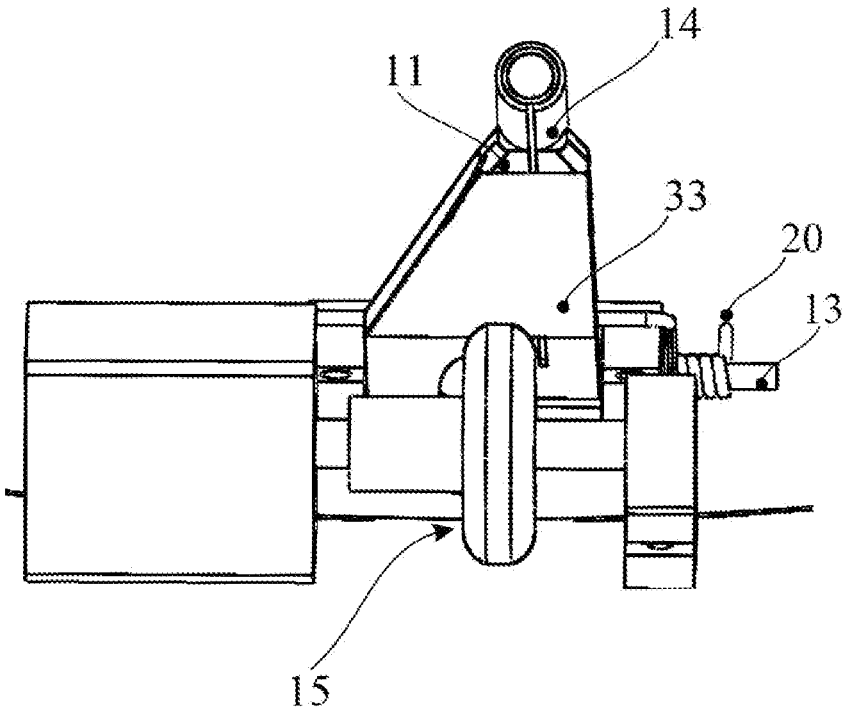
FIG. 5—shows the first extractor design.
Figure 6:
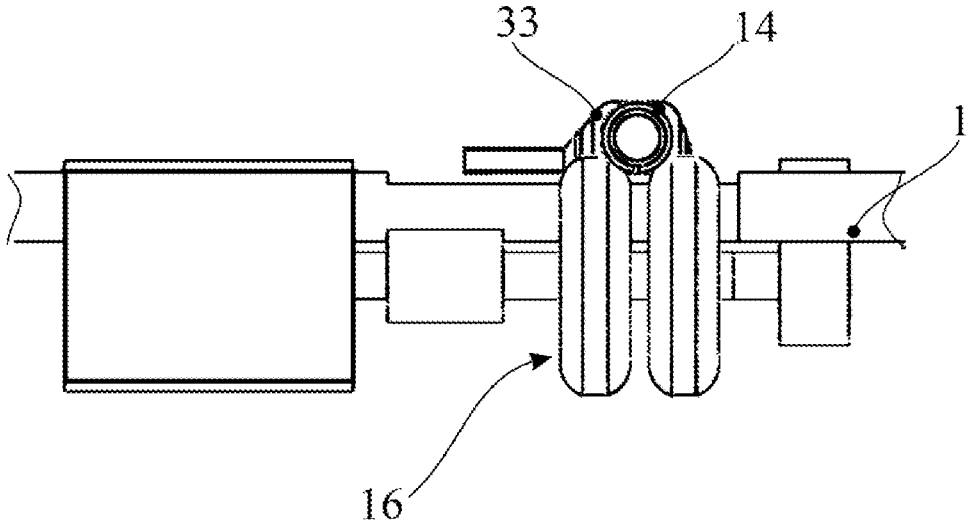
FIG. 6—shows the second extractor design.

Wherein, at least one moving mandrel 10 is equipped with a non-flat shape tip 14 (FIG. 4). An extraction of the formed tubular element out of the moving mandrel 10 can be performed by means of preset extractors (FIG. 5-6). According to at least one embodiment of the invention the set of components comprising a first extractor 15 (FIG. 5) installed on the working table 1, which allows the tubular element longitudinal displacement out of the moving mandrel 10 into the direction of a second extractor 16 (FIG. 6). The second extractor 16 is designed to contact with the non-flat shape tip 14 of each of the moving mandrel 10.

The second extractor 16 (FIG. 6) consists of two eccentric and spring-loaded friction rollers, wherein the said friction rollers contact with the tubular element around the non-flat shape tip 14 of the moving mandrel 10.

Depending on aspects of a technological process, the device may comprise a storage device 17 for finished tubular elements and an additional cleaning unit 18 of the moving mandrel 10.

A storage device 17 for finished tubular elements and the additional cleaning unit 18 for the moving mandrel 10 cleaning, can be integrated into the set of components, for example installed on the working table 1. Also, the said components 17; 18 can be positioned separately.

According to one of possible embodiments described by the invention, the moving mandrel 10 fixing mechanism provides rotation around the moving mandrel rotation axis 19 within a range of up to 270 angular degrees relative to the working table 1 surface.

The said moving mandrel 10 fixing mechanism comprising a spring mechanism 20 (FIG. 5) mounted on the shaft 13 which ensures the moving mandrel 10 pressing the paper workpiece to the first and second side walls 5 and 6 of the master form 3 working surface 4. According to at least one embodiment of the invention (FIG. 2), the moving mandrel rotation axis 19 is perpendicularly positioned relative to a positioning axis 21 of the paper workpiece within the master form 3.

Some embodiments of the invention comprise the moving mandrel 10 installed with a possibility of plane-parallel or rotationally reciprocating motion relative to the moving mandrel rotation axis 19 in the plane perpendicular to the working table's 1 surface.

The trajectories of the moving mandrel movement are directly based on the variant of the moving mandrel 10 fixing mechanism and variant of the moving platform, in particular, variants of the hinged mechanism consist of a set of hinges and kinematic links providing a needed movement trajectory (not shown in the images).

Figure 7:
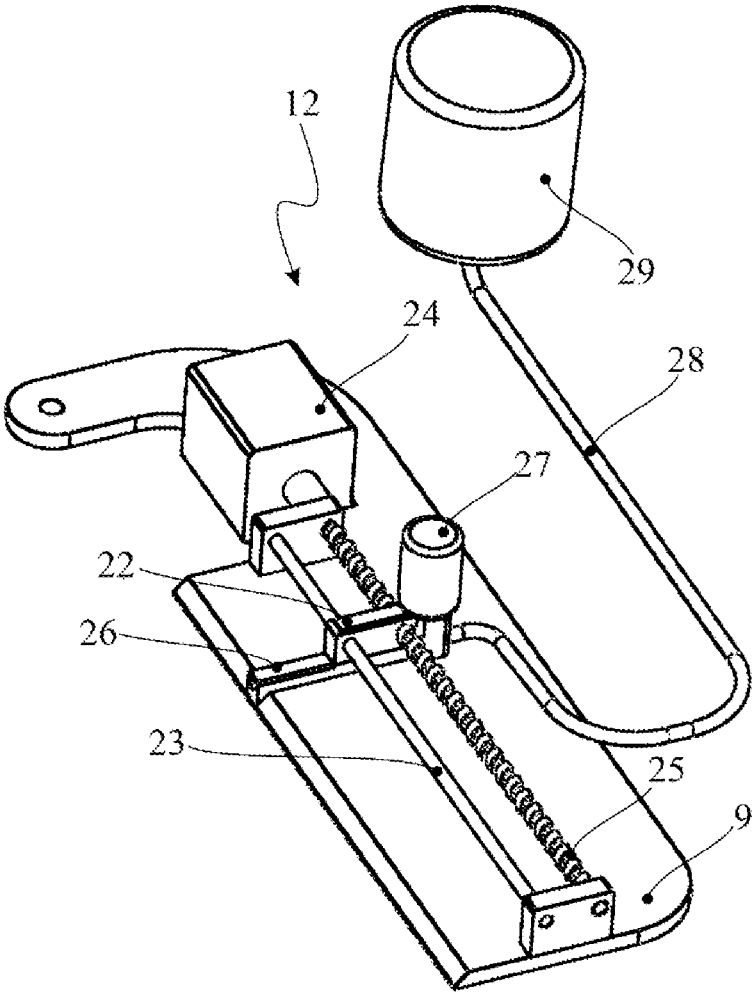
FIG. 7—shows an adhesive application unit.

FIG. 7 shows the variant of the adhesive composition application unit 12 comprising a carriage mechanism 22, at least one guide rod 23, a drive mechanism 24 with a drive rail 25 and a nozzle 26. Wherein, the nozzle 26 is installed on the carriage mechanism 22 and connected to an adhesive capacity 29 through a pump 27 with a pipeline 28.

Figure 8:
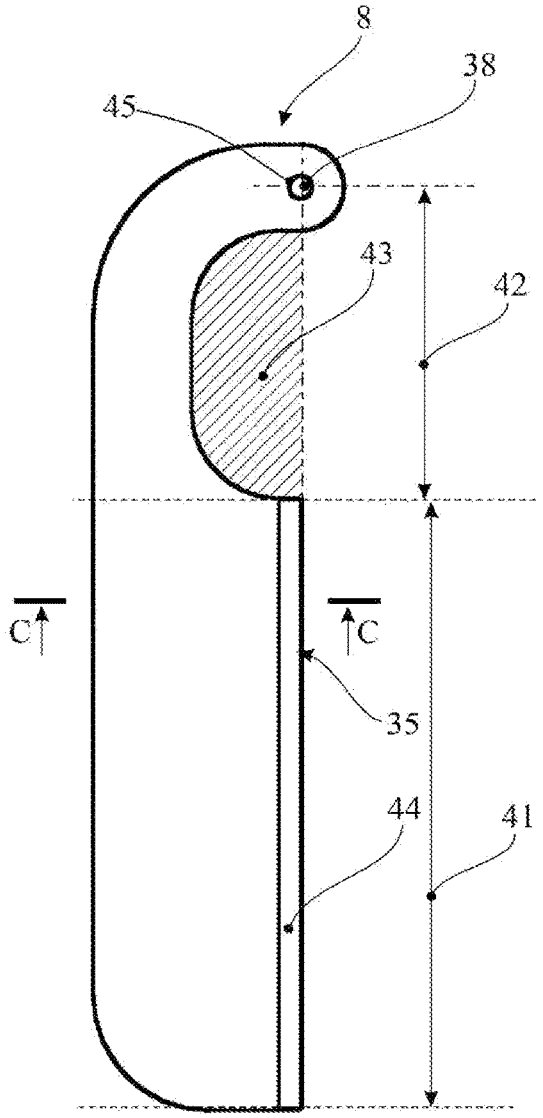
FIG. 8—shows the design of the first forming unit.

The nozzle 26 provides application of a specified amount of adhesive composition on the surface of the paper workpiece. Application of the adhesive composition can also be implemented by another similar mechanism known from the prior art, which provides a similar result. The adhesive composition application unit 12 is preferably installed on the surface of one of the moving forming elements 8 or 9 (FIG. 8; 9).

At least one of the possible embodiments of the invention provides a possibility of rotation of the said forming elements 8 and/or 9 in a parallel plane relative to the work table's 1 surface.

The described embodiments of the invention are characterized by the set of components for the paper workpiece 30 processing, some variants of which will be discussed in more detailed examples.

Figure 12:
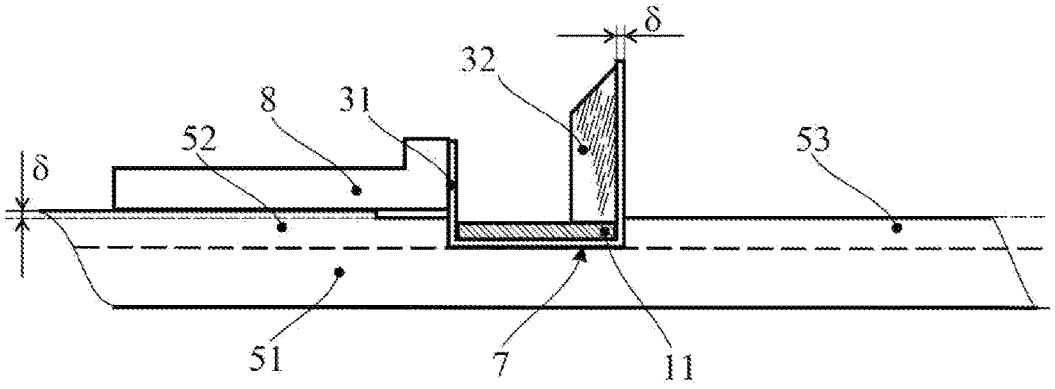
FIG. 12—shows the position of a paper workpiece after folding side sections.
Figure 13:
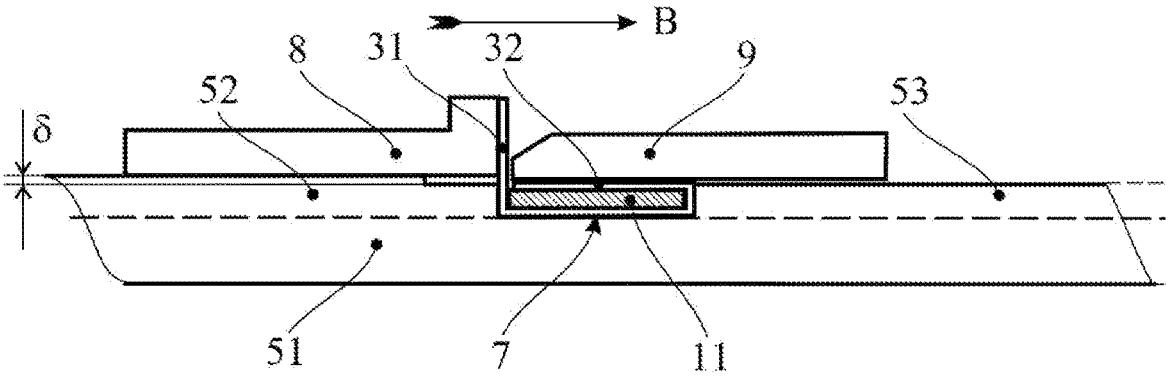
FIG. 13—shows the position of a paper workpiece before an adhesive application.

According to the possible embodiments of the invention, the device is formed for placing the paper workpiece 30 above the master form 3, wherein a first and a second side sections 31, 32 of the paper workpiece 30 are extended out of the working surface 4 of the master form 3 (see FIG. 12 and FIG. 13). The paper workpiece 30 is positioned with its long side along the paper workpiece positioning axis 21 within the master form 3, wherein the side sections 31, 32 are folded at an angle relative to the moving mandrel working surface 4 (FIG. 13) under the moving mandrel's 10 influence.

Figure 14:
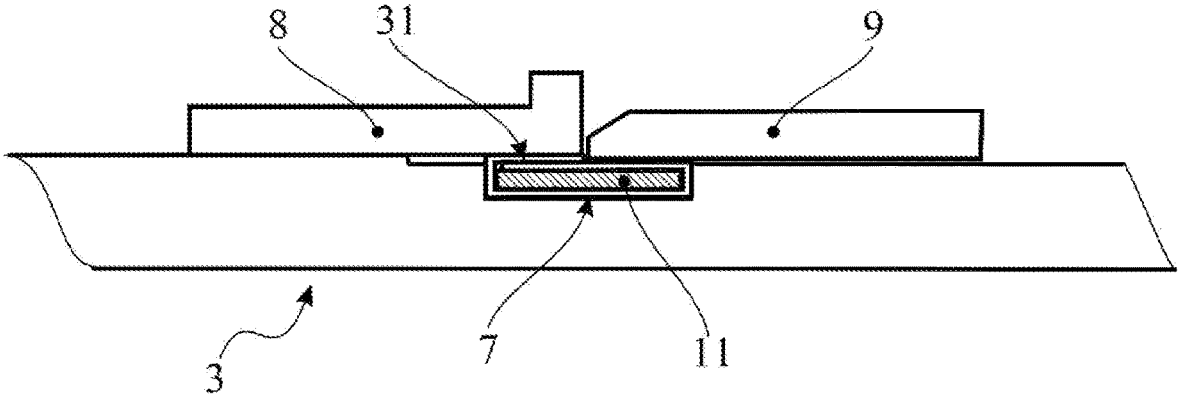
FIG. 14—shows a position of a formed tubular part in a master form.

The first and the second moving forming units 8 and 9 are mounted to fold the said side sections 31, 32 of the paper workpiece 30 around the moving mandrel 10 working section 11 in the shape of a tubular element 33 (FIG. 14).

According to the present embodiment of the invention, the first and the second moving forming units are designed for synchronous moving relative to an arrow B as is disclosed in FIG. 13. Wherein, each of the moving trajectories covers one of the side sections 31, 32 of the paper workpiece 30 folded around the moving mandrel 10. The described structure allows pressing the first side section 31 of the paper workpiece 30 against the second side section 32 while folding the paper workpiece 30 around the moving mandrel 10.

Figure 2:
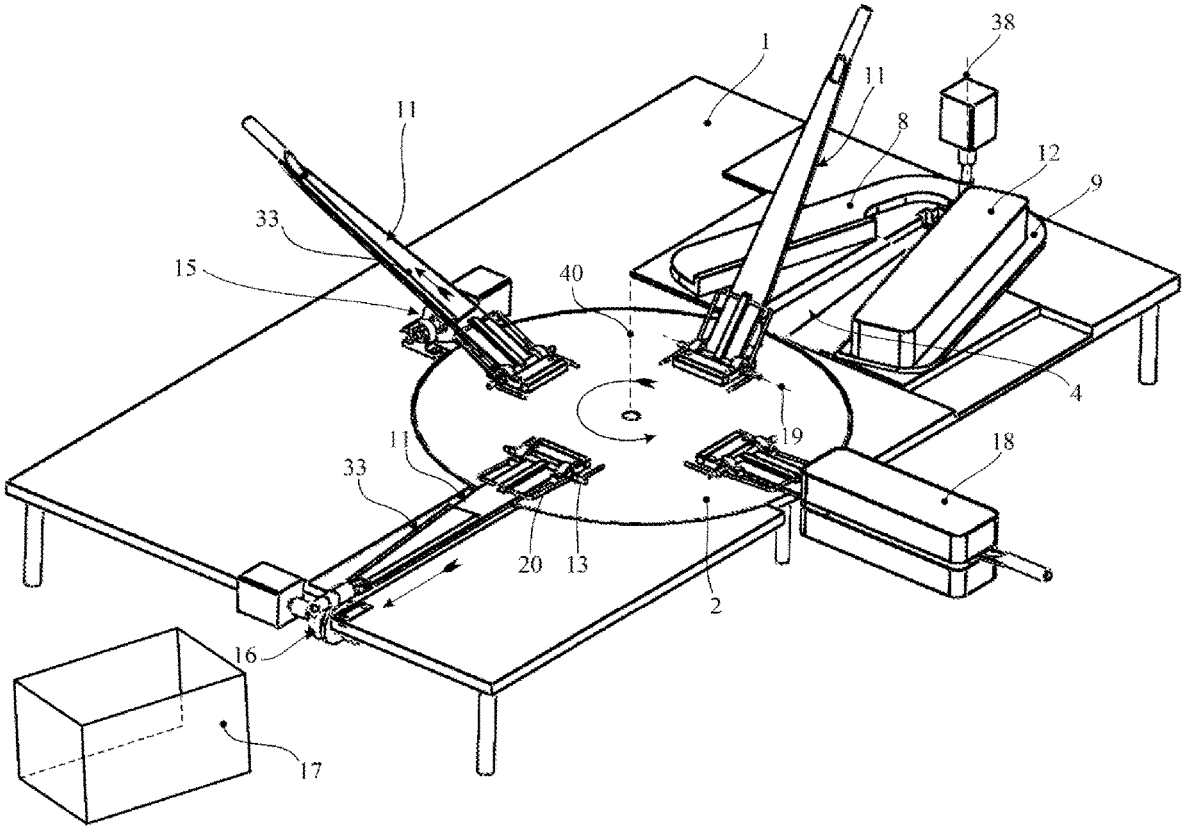
FIG. 2—shows a device for production of a smoking product tubular element (second variant)
Figure 15:
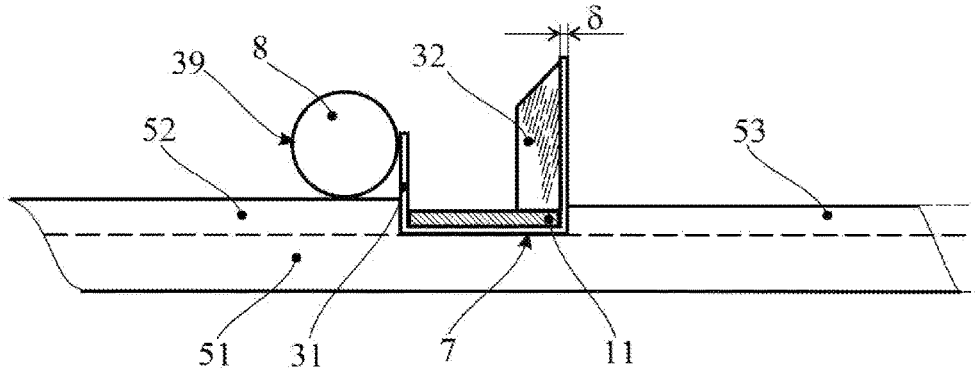
FIG. 15—shows a location of a first forming unit with a cylindrical working surface.

Moreover, the first moving forming unit 8 and the second moving forming unit 9 are equipped with flat working surfaces 34, 35, 36, 37 as it is shown in FIG. 8; 9; 10; 11, wherein the said moving forming units are designed for rotating around a common axis 38 (FIG. 1; 2). Also the first moving forming unit 8 and the second moving forming unit 9 can be designed with an ability of linearly oncoming motion. The said flat working surfaces 34, 35, 36, 37 comprising a first group of flat working surfaces (34; 35) and a second group of flat working surfaces (36, 37) related to the first and the second moving forming units. The first group of flat working surfaces comprising a top working surface (34) and a front working surface (35), and the second group of flat working surfaces comprising a bottom working surface (36) and a side working surface (37). According to one of the possible variants, the first moving forming unit 8 can be designed as a cylindrical working surface 39 (FIG. 15).

The paper workpiece's 30 side sections 31, 32 are perpendicularly folded relative to the bottom surface 7 of the master form 3, wherein the paper workpiece 30 is pressed and folded by the moving mandrel's 10 flat working section 11.

Figure 3:
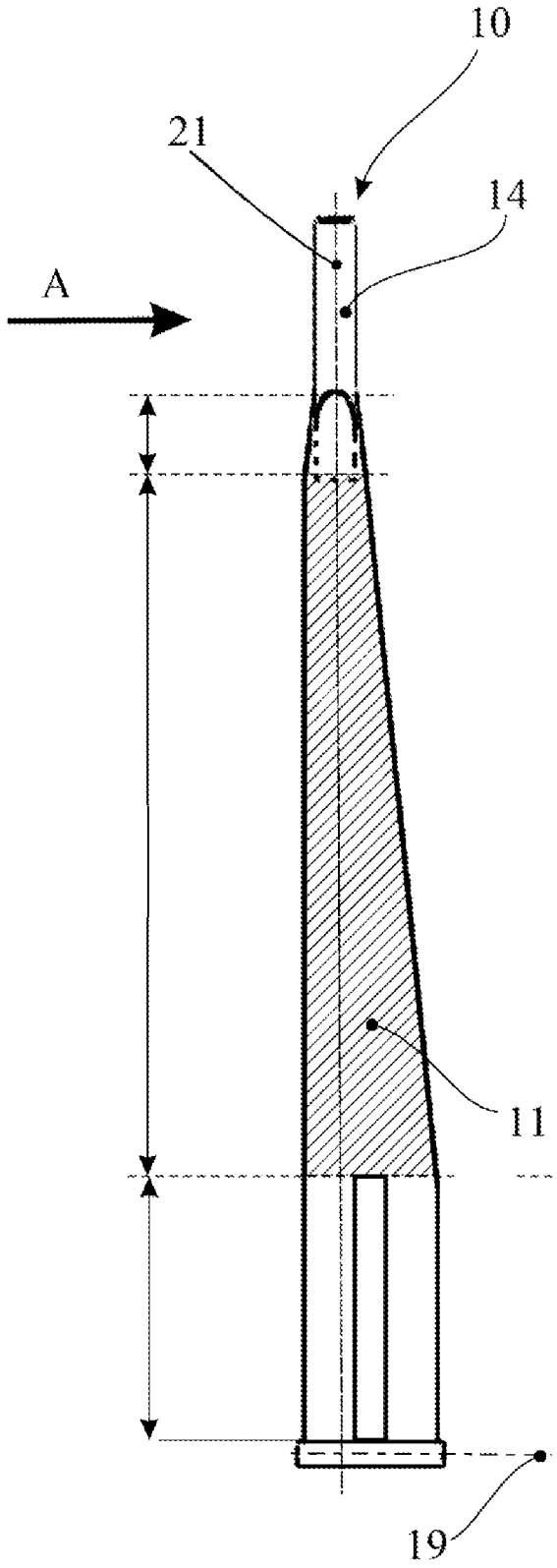
FIG. 3—shows a design of a flat moving mandrel.

According to one of the possible embodiments of the invention, the moving mandrel 10 can be equipped with a non-flat shaped tip 14 as it is shown in FIG. 3. The described structure allows forming a tubular shape of the smoking product tubular element 33 (FIG. 1; 14). The said non-flat shaped tip 14 can be made with different cross sections, such as U-shaped, oval, circle or rectangular shaped.

One of the possible embodiments of the invention (shown in FIG. 2) allows moving the mandrel 10 around the moving platform's 2 axes 40 to press the tubular element 30 surface to the first extractor 15.

Moreover, the moving mandrel 10 is installed to move the mandrel 10 around the moving platform 2 axes 40 to catch or cover the tubular element 30 surface by the second extractor 16.

The described variants of the invention show the moving mandrel 10 divided into sections, comprising the flat working section 11, the moving mandrel 10 fixing mechanism and the non-flat shape tip 14 installation sections.

The moving mandrel's 10 fixing mechanism section is designed for accepting forces from the corresponding elements, rotary spring 20, or additional pusher (not shown) for ensuring leaning or rotating of the moving mandrel 10 around the axis 19 or relative to the moving platform.

Figure 16:
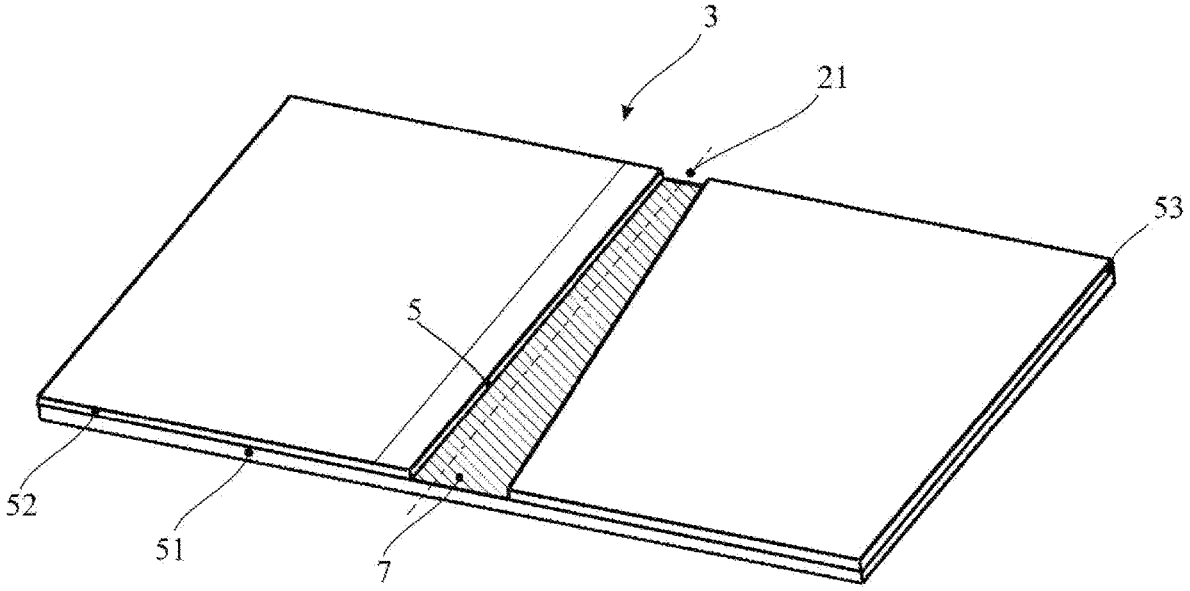
FIG. 16—shows a master form design.
Figure 17:
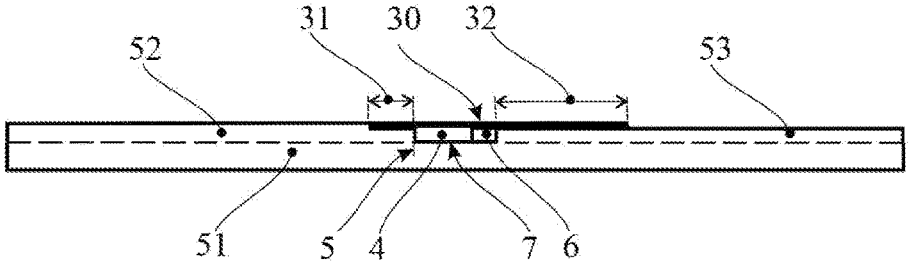
FIG. 17—shows a master form design, front view.

Moreover, the flat working section 11 of the moving mandrel 10 is made with a trapezoid shape elongated along the positioning axes 21 of the paper workpiece within the master form 3 as shown in FIG. 16 and FIG. 17.

Figure 10:
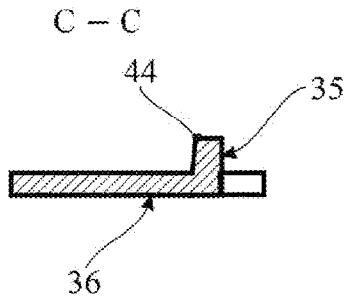
FIG. 10—shows the section C-C in FIG. 8.

According to one of possible embodiments of the invention shown in FIG. 2, the first moving forming unit 8 (see FIGS. 8 and 10) is designed as a flat part, which is made in the form of a figured plate, conditionally divided into a first working section 41 and a first drive section 42. A figured notch 43 is made in the first drive section 42, serving for positioning of the moving mandrel's 10 non-flat shape tip 14.

The first moving forming unit 8 is equipped with the top working surface 34 (see FIG. 8) and a lengthwise stiffening rib 44, forming the front working surface 35, perpendicular to the top working surface 34. The top part of the first moving forming unit 8 in the first drive section 42 comprises a hole 45 with a center coinciding with a common axis 38 in FIG. 2. Wherein, the first moving forming unit 8 and the second moving forming unit 9 are installed with a possibility of rotation around the common axis 38.

Figure 9:
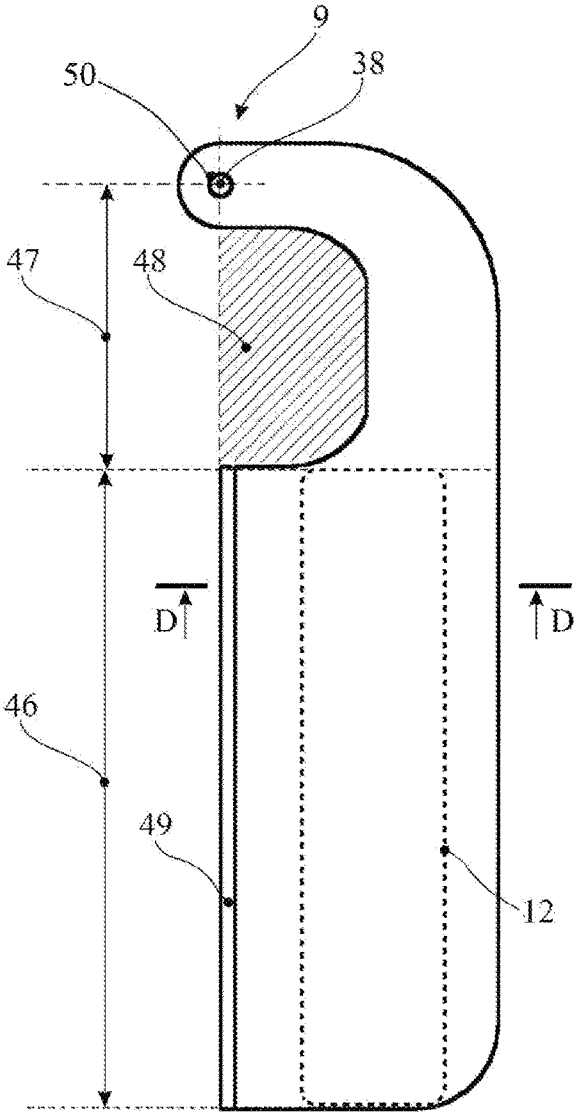
FIG. 9—shows the design of the second forming unit.
Figure 11:
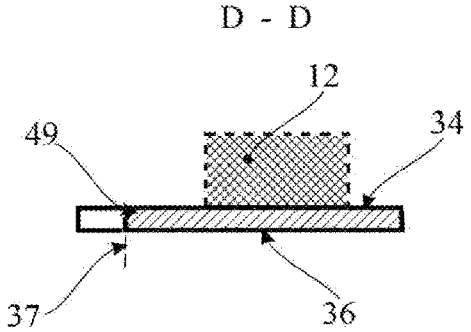
FIG. 11—shows the section D-D in FIG. 9.

The second moving forming unit 9 (see FIG. 10, 11) is installed as a mirror image relative to the first moving forming unit 8 and designed in the shape of a figured plate, conditionally divided into a second working section 46 and a second drive section 47. The second drive section 47 comprises a figured notch 48 FIG. 9, designed for positioning of the moving mandrel's 10 tip 14. The second moving forming unit 9 comprises a bottom working surface 36 (see FIG. 1*l*) and a lengthwise chamfer 49, adjacent to the side working surface 37. The top part of the second moving forming unit 9 in second drive section 47 comprises a hole 50, the center coinciding with the common axis 38.

The master form 3 in (FIG. 16) is designed as a flat base component 51, containing a first limiting flat section 52 and a second limiting flat section 53, which limit the master form's working surface 4.

A method of a smoking product tubular part 33 production by using the claimed set of components for processing the paper workpiece 30 with the help of the master form 3 and the flat moving mandrel 10.

Wherein, placing the paper workpiece 30 above the master form 3, and the paper workpiece first side section 31 and a second side section 32 are spaced out of the master form's 3 working surface 4.

Pressing the paper workpiece 30 to the working surface 4 of the master form 3 by using the moving mandrel 10 flat working section 11, wherein the working surface 4 is formed by a first side wall surface 5, a second side wall surface 6 and a bottom surface 7. After pressing the paper workpiece, moving the first moving forming unit 8 until contacting the first side section 31 of the paper workpiece 30.

Folding the second side section 32 of the paper workpiece 30 around the moving mandrel 10 flat working section 11 by moving the second moving forming unit 9 toward the first moving forming unit 8.

According to one of possible embodiments of the invention, moving the second moving forming unit 9 toward the first moving forming unit 8 till the moment of fixing the first side section 31 between the first and the second moving forming units (8; 9).

Applying an adhesive to the first side section 31 surface of the paper workpiece 30 by using the nozzle 26 or another relevant method. Pressing the first side section 31 to the second side section 32 of the paper workpiece 30 by synchronous movement of the first and second moving forming units (8; 9) toward the direction of an initial position of the second moving forming unit 9. Moving back the first and the second moving forming units (8; 9) after the tubular element 33 has been formed.

Extracting both of the moving mandrel 10 and the formed smoking product tubular element out of the master form 3. Extracting the formed smoking product tubular element by using at least one extractor (15) or (16). During the tubular element extraction, forming a tubular shape of the smoking product tubular element by using the non-flat shape tip 14 of the moving mandrel 10 in combination with the second extractor components.

Moreover, the smoking product tubular element 33 is extracted out of the moving mandrel 10 by using a first extractor 15, wherein the smoking product flat tubular part is formed around the moving mandrel 10.

Moreover, expanding and directing the tubular shaped element (finished tubular element of smoking product) into the storage device 17 by using the second extractor 16.

The present method may provide steps of cleaning the moving mandrel 10 flat working section 11 after each smoking product flat tubular element 33 extraction by using the additional cleaning unit 18.

Thus, the claimed devices and method of manufacturing tubular elements of smoking products allow to simplify the device's design and manufacturing method of tubular elements and increase their reliability.

In addition, in comparison with the prior art, the formation of a direct seam connection of the paper workpiece side sections, allows:

- reduce the amount of adhesive composition required to glue the ends of the paper workpiece,
- reduces the likelihood of the adhesive composition getting on the surface of the tubular element, which in its subsequent use in the smoking products will not compromise the taste characteristics of the smoking product,
- reduces the likelihood of the adhesive composition getting on the moving mandrel and the working surfaces of other set components of the device, thus avoiding sticking of tubular elements, allows to simplify removing finished tubular elements out of the device, does not require a constant adjustment of the air flow to extract the tubular elements or stopping the technological process to remove the finished product manually,
- reduces the number of defective products and reduces production costs.

The claimed device variants and method of manufacturing a tubular element of a smoking product are simple and reliable in use, allowing reducing costs of manufacturing while the quality significantly increases.

Using the Invention

The claimed device (variants 1 and 2) and method of manufacturing a tubular element of a smoking product may be widely used due to the fact that the manufacturing of tubular elements is performed without winding them on the moving mandrel, which greatly simplifies the device and the technology of manufacturing, accelerates the technological process and reduces costs of manufacturing a tubular element.

The use of the invention can be carried out at any specialized enterprise, since the device has a simple manufacturing design, because of simplified technological operations of processing the paper workpiece.

The claimed device or its individual elements can be integrated into existing technological lines.

What we claim is:

1. A device for production of a smoking product tubular element, which consists of a set of components for a paper workpiece processing, wherein the set of components comprising at least:

a working table, a moving platform installed on the working table, a master form fixed on the working table surface, wherein the master form's working surface is formed by a first side wall surface, a second side wall surface and a bottom surface, a first moving forming unit and a second moving forming unit are placed on the working table on both sides of the master form, at least one moving mandrel, wherein the moving mandrel is designed with a flat working section and installed for movement relative to the moving platform, wherein the moving mandrel is equipped with a non-flat shape tip;

wherein the moving mandrel is designed for pressing the paper workpiece to the working surface of the master form, and the moving mandrel is designed to be folded by the paper workpiece around the flat working section by an influence of the first and second moving forming units, wherein the smoking product tubular element is formed around the moving mandrel in the flat working section shape.

2. A device for production of a smoking product tubular element which consists of a set of components for a paper workpiece processing, wherein the set of components comprising at least:

a working table, a rotating platform installed on the working table, a master form fixed on the working table surface and positioned radially to the rotating platform with a working surface for the paper workpiece positioning, wherein the working surface is formed by a first side wall surface, a second side wall surface and a bottom surface, a first moving forming unit and a second moving forming unit are placed on the working table radially to the rotating platform, wherein the first moving forming unit and the second moving forming unit are formed to cover the master form on two opposite sides, wherein the second moving forming unit is equipped with an adhesive composition application unit, at least four moving mandrels hinged to the rotating platform by a shaft, wherein each of the moving mandrel is designed for rotation in a plane perpendicular to the working table surface, wherein each of the moving mandrel is designed with a flat working section for pressing the paper workpiece to the working surface of the master form, wherein at least one moving mandrel is equipped with a non-flat shape tip, wherein the smoking product tubular element is formed around the moving mandrel in a shape of the flat working section;

wherein the set of components comprising a first extractor and a second extractor installed on the working table, the first extractor is designed for the tubular element longitudinal displacement out of the moving mandrel, the second extractor is designed in contact with the non-flat shape tip of each of the moving mandrels.

3. The device according to claim 1, wherein comprising a storage device and an additional cleaning unit of the moving mandrel.

4. The device according to claim 2, wherein the moving mandrel is installed for rotating around the moving mandrel rotation axis within a range of up to 270 angular degrees.

5. The device according to claim 2, wherein the mandrel fixing mechanism comprising a spring mechanism mounted on the shaft.

6. The device according to claim 2, wherein the second extractor consists of two eccentric and spring-loaded friction rollers, wherein said friction rollers contact with the tubular element around the non-flat shape tip of the moving mandrel.

7. The device according to claim 1, wherein the moving mandrel flat working section is made with a thickness of at least 0.5 mm.

8. The device according to claim 2, wherein the moving mandrel rotation axis is perpendicular to a positioning axis of the paper workpiece within the master form.

9. The device according to claim 1, wherein the moving mandrel is installed with a possibility of plane-parallel or rotationally reciprocating motion in the plane perpendicular to the working table surface.

10. The device according to claim 2, wherein the adhesive composition application unit comprising a carriage mechanism, at least one guide rod, a drive mechanism with a drive rail, a nozzle, wherein the nozzle is installed on the carriage mechanism and connected to an adhesive capacity through a pump with a pipeline.

11. The device according to claim 1, wherein at least one of said moving forming units is designed to move in a parallel plate relative to the working table surface.

12. The device according to claim 1, wherein the moving mandrel is positioned on the rotating platform or on the working table surface.

13. A method of a smoking product tubular element production by using a set of components for a paper workpiece processing comprising the steps:

a) placing a paper workpiece above a master form, wherein the paper workpiece first side section and a second side section are spaced out of the master form's working surface;

b) pressing the paper workpiece to the working surface of the master form by using a moving mandrel, wherein the working surface is formed by a first side wall surface, a second side wall surface and a bottom surface;

c) moving a first moving forming unit until contacting the first side section of the paper workpiece;

d) folding the second side section of the paper workpiece around the moving mandrel's flat working section by moving the second moving forming unit toward the first moving forming unit, wherein fixing the first side section between the first and the second moving forming units;

e) applying an adhesive to the first side section surface of the paper workpiece;

f) pressing the first side section to the second side section of the paper workpiece by synchronous movement of the first and second moving forming units toward a direction of an initial position of the second moving forming unit;

g) moving back the first and the second moving forming units;

h) extracting the moving mandrel together with a formed smoking product tubular element out of the master form;

i) extracting the formed smoking product tubular element by using of at least one extractor.

14. The method according to claim 13, wherein moving the second moving forming unit toward the first moving forming unit till the moment of fixing the first side section of the paper workpiece between the first and the second moving forming units.

15. The method according to claim 13, wherein forming a tubular shape of the smoking product tubular element by using at least a non-flat shape tip of the moving mandrel.

16. The device according to claim 2, wherein comprising a storage device and an additional cleaning unit of the moving mandrel.

17. The device according to claim 2, wherein the moving mandrel flat working section is made with a thickness of at least 0.5 mm.

18. The device according to claim 2, wherein the moving mandrel is installed with a possibility of plane-parallel or rotationally reciprocating motion in the plane perpendicular to the working table surface.

19. The device according to claim 2, wherein at least one moving forming unit is designed to move in a parallel plate relative to the working table surface.

20. The device according to claim 2, wherein the moving mandrel is positioned on the rotating platform or on the working table surface.

* * * * *